US006192803B1

(12) United States Patent
Nishino

(10) Patent No.: US 6,192,803 B1
(45) Date of Patent: Feb. 27, 2001

(54) TRAVEL CONTROL SYSTEM FOR TRANSPORT MOVERS

(75) Inventor: Shuzo Nishino, Kawanishi (JP)

(73) Assignee: Daifuku Co., Ltd., Osaka (JP)

( * ) Notice: Subject to any disclaimer, the term of this patent is extended or adjusted under 35 U.S.C. 154(b) by 0 days.

(21) Appl. No.: 09/146,569

(22) Filed: Sep. 3, 1998

(51) Int. Cl.[7] ..... B61B 5/00

(52) U.S. Cl. ..... 104/93; 104/89; 104/249; 105/148; 105/150

(58) Field of Search ..... 104/249, 89, 93; 105/148, 150; 340/500, 547, 552, 572.1; 307/117, 125

(56) References Cited

U.S. PATENT DOCUMENTS 2,454,687 * 11/1948 Baughman ..... 340/500
3,281,779 * 10/1966 Yeiser ..... 340/500
4,041,448 * 8/1977 Noens ..... 340/32
4,984,521 * 1/1991 Riley ..... 104/290
5,227,764 * 7/1993 Umemoto ..... 340/552
5,233,294 * 8/1993 Dreoni ..... 324/207
5,450,796 * 9/1995 Sakagami ..... 104/89
5,519,317 * 5/1996 Guichard et al. ..... 324/326
5,535,963 * 7/1996 Lehl et al. ..... 244/3
5,619,188 * 4/1997 Ehlers ..... 340/686

* cited by examiner

*Primary Examiner*—S. Joseph Morano
*Assistant Examiner*—Frantz Jules
(74) *Attorney, Agent, or Firm*—Reising, Ethington, Barnes, Kisselle, Learman & McCulloch, PC

(57) ABSTRACT

A proximity sensor (22), which generates an alternating current magnetic field in the direction of a guide rail (B) and detects a detection object by a loss of energy caused by a current which this alternating current magnetic field generates to flow to the detection object, is provided at the front end of each transport mover (V); a rear-end collision prevention detection plate (23), which enters between the guide rail (B) and the proximity sensor (22), is provided at the rear end of each transport mover (V); and a stopping device (W), which faces toward the proximity sensor (22) and forms a resonant circuit resonating at the generation frequency of the proximity sensor (22), is provided at a mover stopping location on the guide rail (B).

3 Claims, 9 Drawing Sheets

TRAVEL CONTROL SYSTEM FOR TRANSPORT MOVERS

BACKGROUND OF THE INVENTION

1. Field of the Invention

The present invention relates to a travel control system for a plurality of transport movers that move under their own power along a rail.

2. Description of the Related Art

A well-known transport mover travel control system is disclosed in Japanese Patent Publication No. 7-75982.

With this system, the following configuration is provided to stop and start a transport mover at a stopping location along a rail.

That is, a stop detection plate and a light projector for stop cancel command are provided at the abovementioned transport mover stopping location, and the abovementioned transport mover is provided with a stop proximity sensor which stops travel by detecting the abovementioned stop detection plate, and with a light receptor which cancels the detection plate detection signal of the abovementioned proximity sensor, i.e. to start the mover, by receiving light from the abovementioned light projector.

To prevent the abovementioned transport movers from colliding with one another, the following configuration is provided.

The abovementioned transport mover is provided with a bracket that protrudes forward, and this bracket is provided with a rear-end collision prevention proximity sensor and a rear-end collision prevention reflection-type photoelectric switch. The abovementioned transport mover is also provided with a rear-end collision prevention proximity sensor detection plate that protrudes rearward, and this detection plate is provided with a reflective surface for the abovementioned photoelectric switch.

However, the above-described configuration of the well-known transport mover travel control system gives rise to the following problems.

Each mover is equipped with numerous sensors, i.e. a transport mover stop proximity sensor and a light receptor, and a transport mover rear-end collision prevention proximity sensor and a photoelectric switch, and wiring is also required for these sensors, thereby increasing the costs of the system.

SUMMARY OF THE INVENTION

Accordingly, an object of the present invention is to provide a transport mover travel control system capable of solving these problems and reducing the costs.

To achieve this object, the present invention is a travel control system for a plurality of transport movers that move under their own power along a rail, comprising: a proximity sensor provided at the front end of each of said transport movers and generating an alternating current magnetic field in the direction of the rail; a detection object of said proximity sensor provided at the rear end of each of said transport movers and entering between the rail and the proximity sensor; and a resonant circuit provided at a mover stopping location on the rail, said resonant circuit facing toward the proximity sensor and resonating at a generation frequency of the proximity sensor; said alternating current magnetic field generating a current which flows to the detection object or the resonant circuit while consuming energy, thereby allowing the proximity sensor to detect the detection object or the resonant circuit by said energy consumption.

In accordance with this configuration, the proximity sensor detects the detection object provided at the rear end of a transport mover traveling in the forward direction, and the resonant circuit provided at a mover stopping location on the rail. The alternating current magnetic field generated by the proximity sensor generates an eddy current which flows to the detection object while consuming energy due to the resistance of the detection object caused by said eddy current, whereby the proximity sensor detects the detection object by such energy consumption. Further, the alternating current magnetic field generated by the proximity sensor generates a resonance current which flows to the resonant circuit resonating at a generation frequency of the proximity sensor while consuming energy due to the resistance of the resonant circuit caused by said resonance current, whereby the proximity sensor detects the resonant circuit by such energy consumption. The detection distance of the proximity sensor increases at this time, enabling the distance between the proximity sensor and a resonant circuit to be extended, and the proximity sensor is capable of detecting a resonant circuit even when the resonant circuit is beyond the ordinary detection range.

DESCRIPTION OF THE PREFERRED EMBODIMENTS (Embodiment 1)

Figure 1:
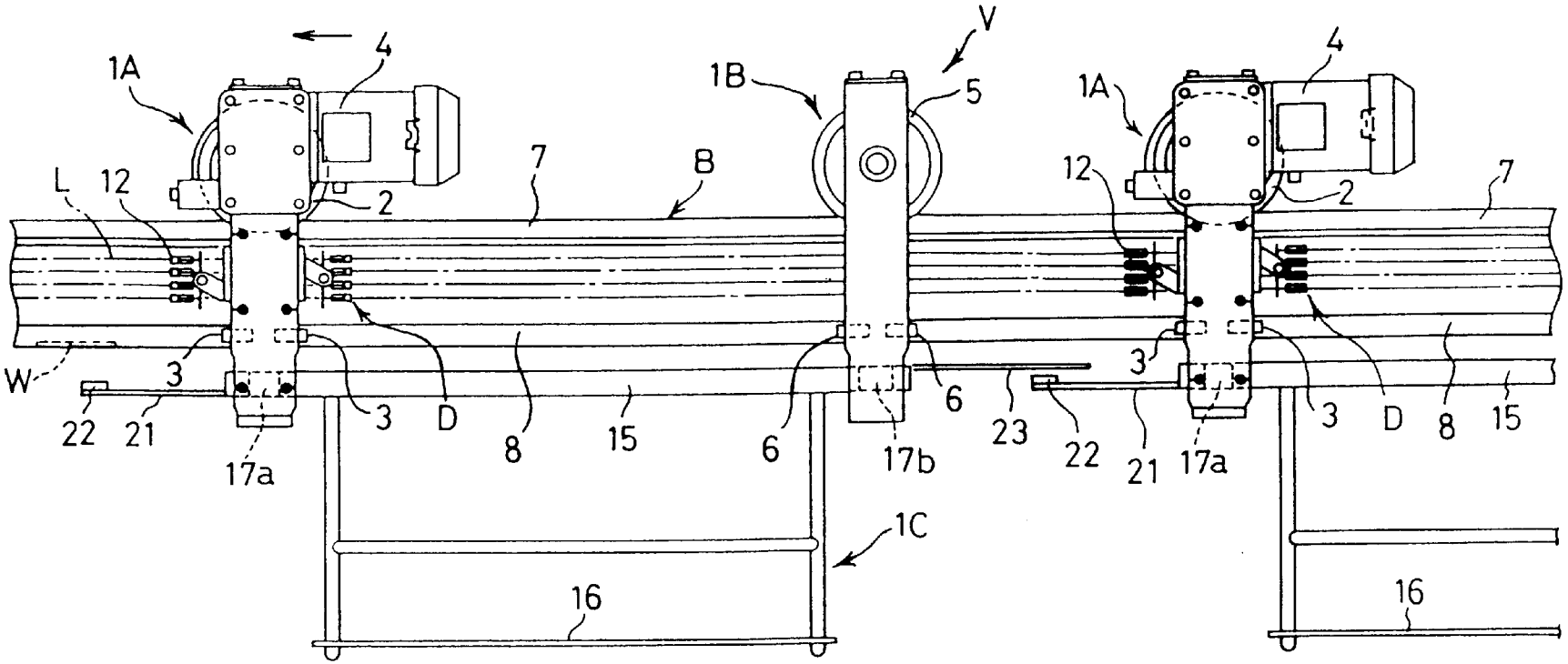
FIG. 1 is a side view of a rail and a transport mover equipped with a transport mover travel control system of a first embodiment of the present invention.
Figure 2:
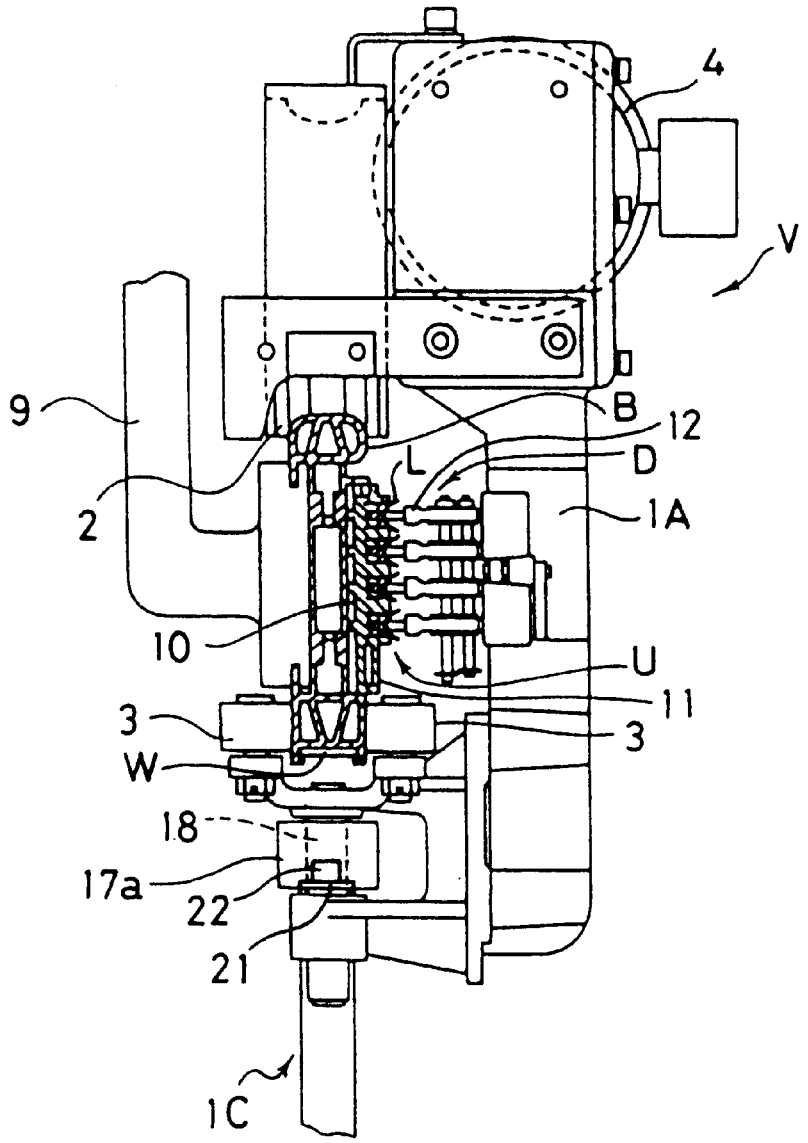
FIG. 2 is a partial cross-sectional front view of the rail and the transport mover equipped with the transport mover travel control system.

First, a transport mover travel control system-equipped transport mover and a rail thereof are explained in accordance with FIG. 1 and FIG. 2.

A transport mover V comprises a drive trolley 1A, a driven trolley 1B, and a freight transport carrier 1C supported by these trolleys 1A, 1B. And, as the abovementioned rail, an aluminum guide rail B for guiding this transport mover in its unrestricted locomotion is provided.

The abovementioned drive trolley 1A comprises a traveling wheel 2 engaging with the top part of the guide rail B, side anchor rollers 3 contacting the bottom part of the guide rail B from both sides, a current collector unit D, and a reduction gear-equipped electric motor 4 for driving the abovementioned traveling wheel 2.

Further, the abovementioned driven trolley 1B comprises a traveling wheel 5 engaging with the top part of the guide rail B, and side anchor rollers 6 contacting the bottom part of the guide rail B from both sides.

The abovementioned guide rail B comprises a wheel guide part 7 on the top part thereof and a roller guide part 8 on the bottom part thereof. And this guide rail B is supported in a suspended state from a ceiling by a frame 9 connected to one side. Further, a current-carrying rail unit U is mounted to the guide rail B on the side opposite the side to which the frame 9 of the guide rail B is mounted.

The abovementioned current-carrying rail unit U is provided to supply power in the form of three-phase alternating current to the transport mover V and also to transmit travel control signals to the transport mover V, and comprises four current-carrying rails L. Each of these four current-carrying rails L is supported in a parallel state by a rail frame 10. The rail frame 10 is secured via screws to a pair of fasteners 11 provided on the top and bottom of the guide rail B.

The abovementioned current collector unit D comprises a pair of current collectors 12 for each current-carrying rail L. A pair of current collectors 12 for a current-carrying rail L are positioned separately with a space therebetween in the front-and-rear direction of the transport mover V, and the four current collectors 12 on the front of the car body form one unit, and similarly, the four current collectors 12 on the rear of the car body form one unit.

The abovementioned carrier 1C comprises a coupling member 15 for connecting both trolleys 1A, 1B, and a freight support platform 16 suspended below from this coupling member 15. Bearing members 17*a*, 17*b* are attached at both front and rear ends of the abovementioned coupling member 15. The vertical spindles 18 of both trolleys 1A, 1B are rotatably connected to each of these bearing members 17*a*, 17*b*.

Further, a bracket 21 which protrudes in the forward direction is mounted to the front bearing member 17*a* of the coupling member 15. And a proximity sensor 22 is provided at the front end of this bracket 21. This proximity sensor 22 generates a high frequency (for example 300 kHz) alternating current magnetic field in the direction of the guide rail B, and detects a detection object via the energy loss resulting from the current generated by this alternating current magnetic field. Further, an iron-made rear-end collision prevention detection plate 23 which protrudes toward the rear is mounted to the rear bearing member 17*b* of the coupling member 15 at a location between the abovementioned bracket 21 and the guide rail B.

Further, at the stopping location of a transport mover V, a stopping device W is provided on the bottom surface of the guide rail B facing the proximity sensor 22.

Figure 3A:
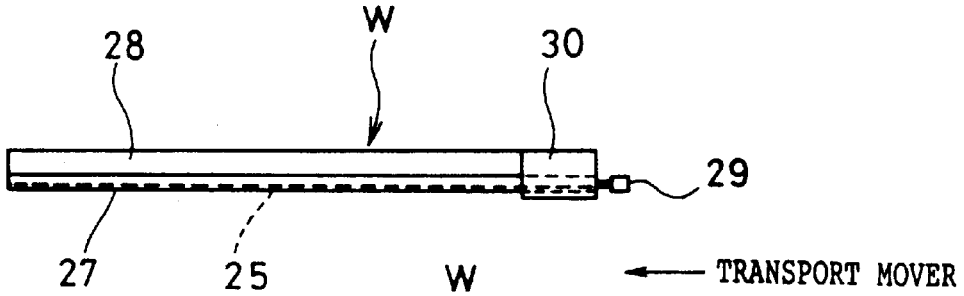
FIG. 3*a* is a side view and FIG. 3*b* is a bottom view of a stopping device of the transport mover travel control system.
Figure 3B:
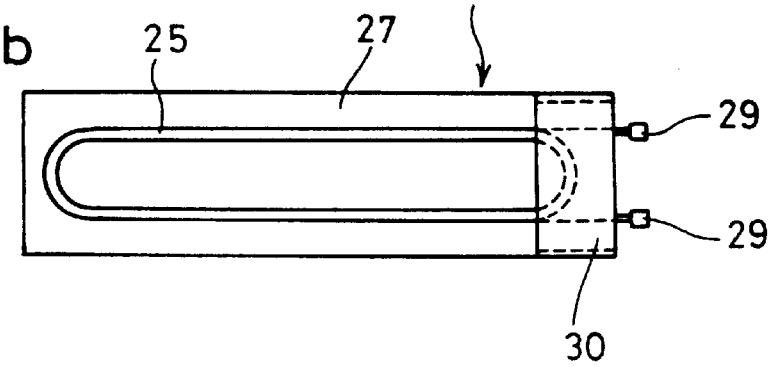

This stopping device W, as shown in FIG. 3, comprises a printed wiring board 27, into the surface of which is molded a coil 25 with a plurality of turns, a ferrite plate 28, to the underside of which is affixed this printed wiring board 27, extractable terminals 29, which are connected to both ends of the abovementioned coil 25, and a high-frequency magnetic field cut-off material 30, which is mounted to the ends of the abovementioned printed wiring board 27 and ferrite plate 28 in the direction the transport mover V enters.

Figure 4A:
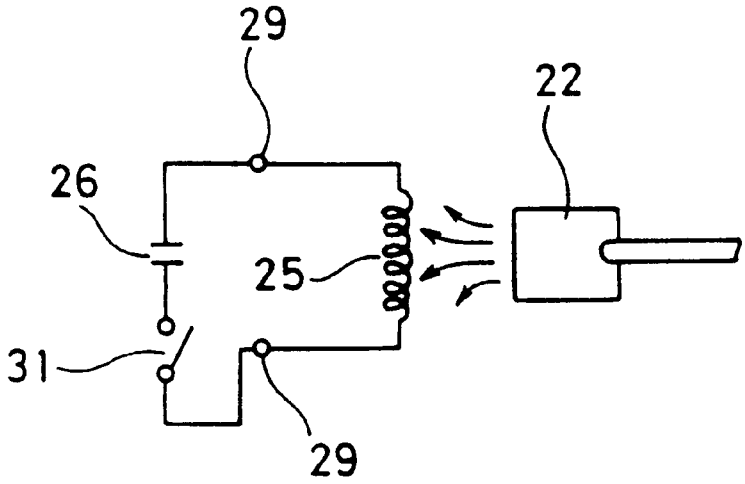
FIG. 4*a* and FIG. 4*b* each shows a circuit diagram of the stopping device of the transport mover travel control system.

And as shown in FIG. 4*a*, a condenser 26 and a stop switch 31 are connected in series via extractable terminals 29 to the coil 25 of the abovementioned stopping device W. When the abovementioned stop switch 31 is in the ON state, the coil 25 and condenser 26 form a resonant circuit which resonates at the generation frequency (described above as 300 kHz) of the proximity sensor 22. The condenser 26 can also be molded to the printed wiring board 27 together with the coil 25.

Figure 5:
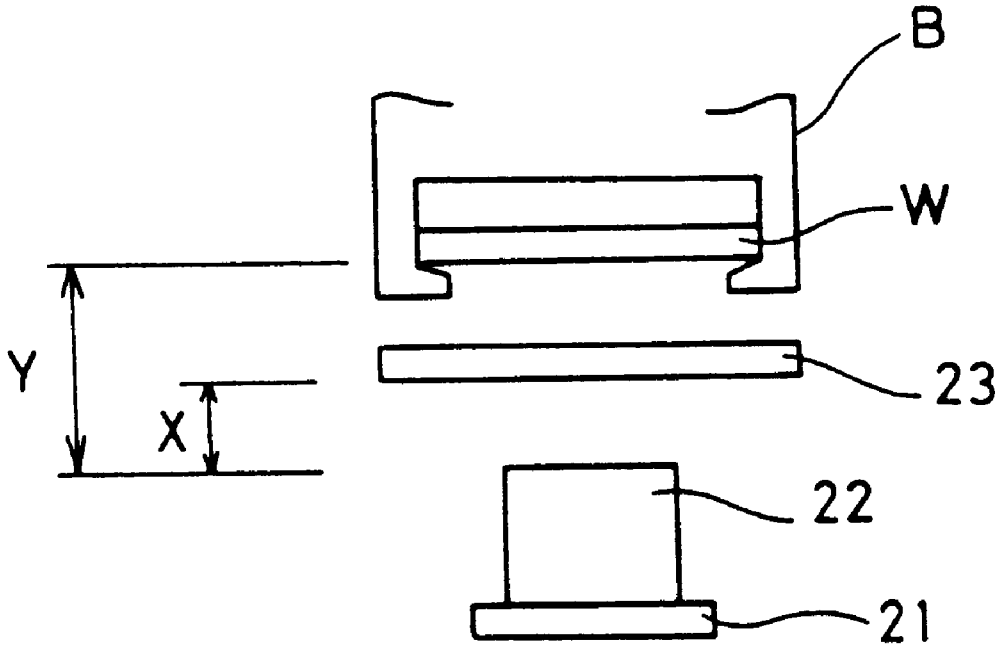
FIG. 5 is a diagram depicting the locations of a stopping device, a detection plate and a proximity sensor of the transport mover travel control system.

FIG. 5 shows the positional relationship of the stopping device W, the rear-end collision prevention detection plate 23 and the proximity sensor 22.

The rear-end collision prevention detection plate 23 is positioned at the detection distance X of the proximity sensor 22 (for example, 20 mm), and when the coil 25 of the stopping device W and the condenser 26 form a resonant circuit, the stopping device W is positioned at a distance Y at which the proximity sensor 22 is capable of detection. When there is a resonant circuit that resonates at the generation frequency of the proximity sensor 22, the proximity sensor 22 is capable of detecting this resonant circuit by the energy consumed by the resistance inside the circuit when current flows through the coil 25 in response to the circuit resonating to the alternating current magnetic field of the proximity sensor 22. The detection distance Y of the proximity sensor 22 can be increased at this time (a distance twice the detection distance X is possible), and the detection distance between the proximity sensor 22 and the resonant circuit, i.e. the stopping device W, can be increased. Therefore, when the stopping device W is positioned at a location farther than the ordinary detection distance X but closer than the detection distance Y, it is possible to create a state in which the stopping device W is detected by the proximity sensor 22 only when it is in a resonating state and the stopping device W is not detected by the proximity sensor 22 when it is in a non-resonating state.

The operational process will be explained in accordance with the above-described configuration.

Power is supplied via current collectors 12 to a transport mover V from current-carrying rails L of the current-carrying rail unit U of the guide rail B. When the proximity sensor 22 is OFF, power is supplied to the reduction gear-equipped electric motor 4. A traveling wheel 2 is driven by the powered reduction gear-equipped electric motor 4, and the transport mover V is guided to move by the guide rail B.

Then, in accordance with its own movement, the transport mover V approaches a preceding transport mover V, and when the proximity sensor 22 detects the rear-end collision prevention detection plate 23 of the preceding transport mover V and turns ON, the supply of power to the reduction gear-equipped electric motor 4 is cut off, the driving of the traveling wheel 2 by the reduction gear-equipped electric motor 4 stops, and the transport mover V comes to a halt. Thus, the transport mover V avoids a rear-end collision with the preceding transport mover V.

Further, when the transport mover V passes a predetermined stopping location, the stop switch 31 on the stopping device W turns ON, forming a resonant circuit, and the proximity sensor 22 detects this resonant circuit and turns ON. When the proximity sensor 22 turns ON, the supply of power to the reduction gear-equipped electric motor 4 is cut off, the driving of the traveling wheel 2 by the reduction gear-equipped electric motor 4 stops, and the transport mover V comes to a halt. Thus, the transport mover V stops at the predetermined stopping location. In this state, when the stop switch 31 on the stopping device W turns OFF, the stopping device W enters a non-resonating state, and the proximity sensor 22 turns OFF. When the proximity sensor 22 turns OFF, power is re-supplied to the reduction gear-equipped electric motor 4, and the transport mover V starts. Furthermore, when the stop switch 31 is in the OFF state prior to the approach of the transport mover V to a stopping location, the stopping device W is not detected by the proximity sensor 22, and the transport mover V passes the stopping location without stopping.

In this way, the proximity sensor 22 can be used both as a rear-end collision prevention sensor (strain sensor) and as a stop/start sensor. The number of sensors can thus be reduced, the amount of wiring on the transport mover V can be reduced, and costs can be reduced. In addition, a space can be left between the stopping device W and the rear-end collision prevention detection plate 23, and between the rear-end collision prevention detection plate 23 and the proximity sensor 22, making it possible to prevent malfunctions and improper operation resulting from the vibration of the transport mover V.

Figure 4B:
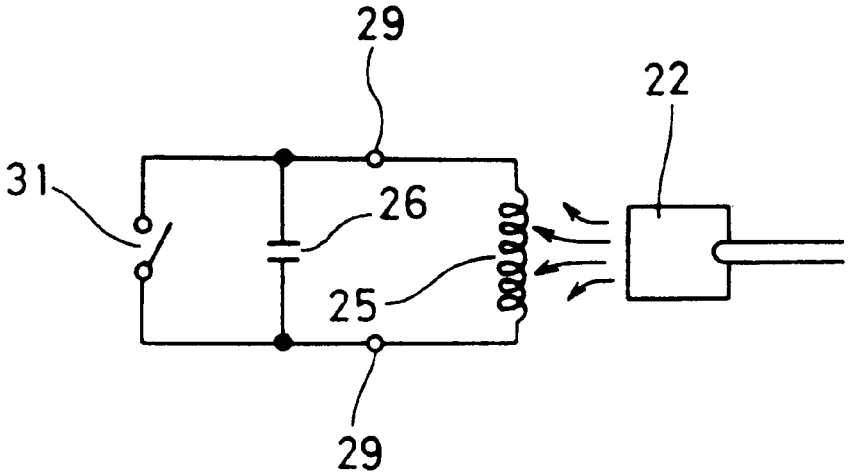

Furthermore, with the above-described stopping device W, the condenser 26 is connected in series to the stop switch 31. However, as shown in FIG. 4*b*, the condenser 26 can also be connected in parallel to the stop switch 31. In this case, the stopping device W enters a resonating state when the stop switch 31 is OFF, and the stopping device W is in a non-resonating state when the switch is ON.

(Embodiment 2)

Figure 6:
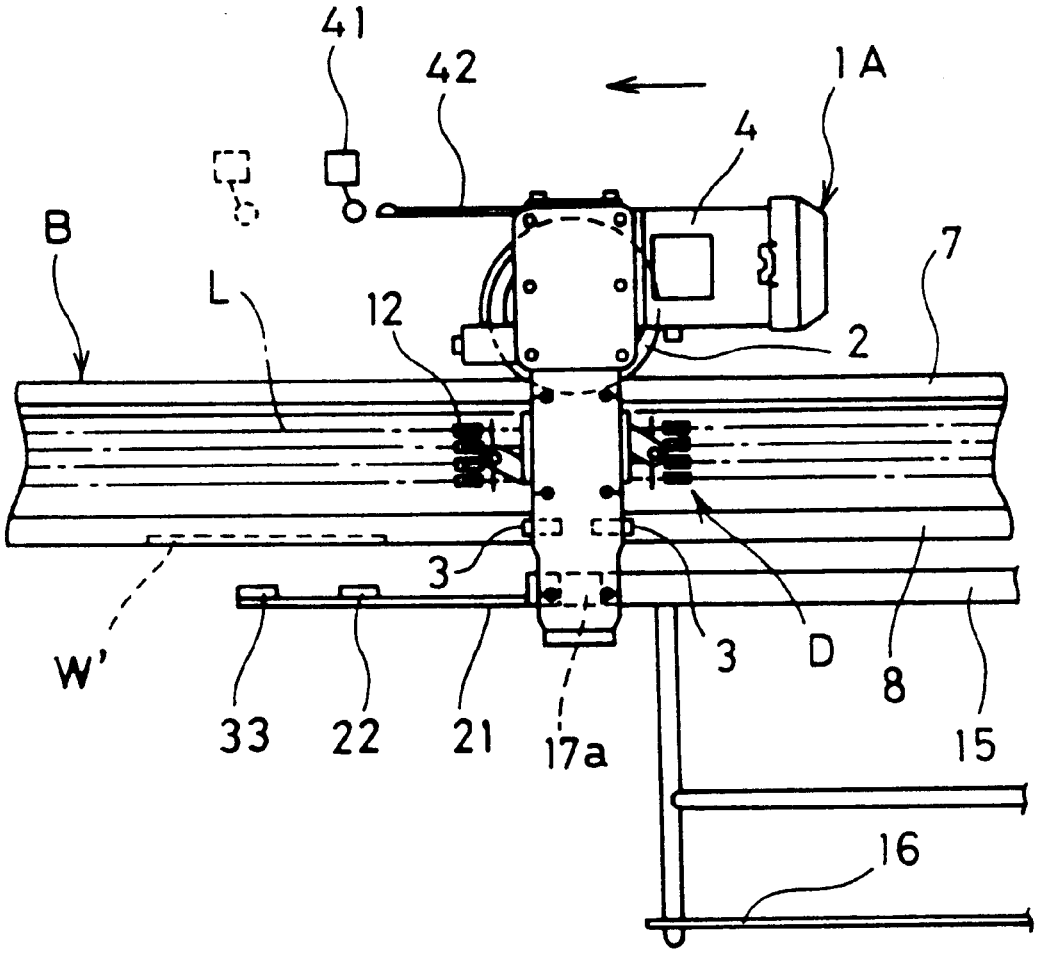
FIG. 6 is a side view of a rail and a transport mover equipped with a transport mover travel control system of a second embodiment of the present invention.

In a second embodiment, the first embodiment are changed in the following points as shown in FIG. 6.

1. To the bracket 21 which protrudes forward from the front bearing member 17*a*, a second proximity sensor 33 is provided in addition to the above-described proximity sensor 22.

2. In place of the stopping device W, a speed reducing/stopping device W' is provided.

3. A limit switch 41 is provided over a guide rail B equipped with a speed reducing/stopping device W', ard a driver 42 which operates this limit switch 41 is provided at the tip of the drive trolley 1A.

The abovementioned changes will be explained in detail.

The abovementioned second proximity sensor 33 is provided further toward the front of the bracket 21 than the above-described proximity sensor 22, generates in the direction of the guide rail B a high frequency (500 kHz, for example) alternating current magnetic field which differs from that of proximity sensor 22, and detects a detection object by the energy loss resulting from the current generated by this alternating current magnetic field. This second proximity sensor 33 is used to detect a speed reducing location.

Further, a speed reducing/stopping device W' is provided at a speed reducing/stopping location of the transport mover V on the bottom surface of the guide rail B so as to face the proximity sensor 22.

Figures 7A, 7B:
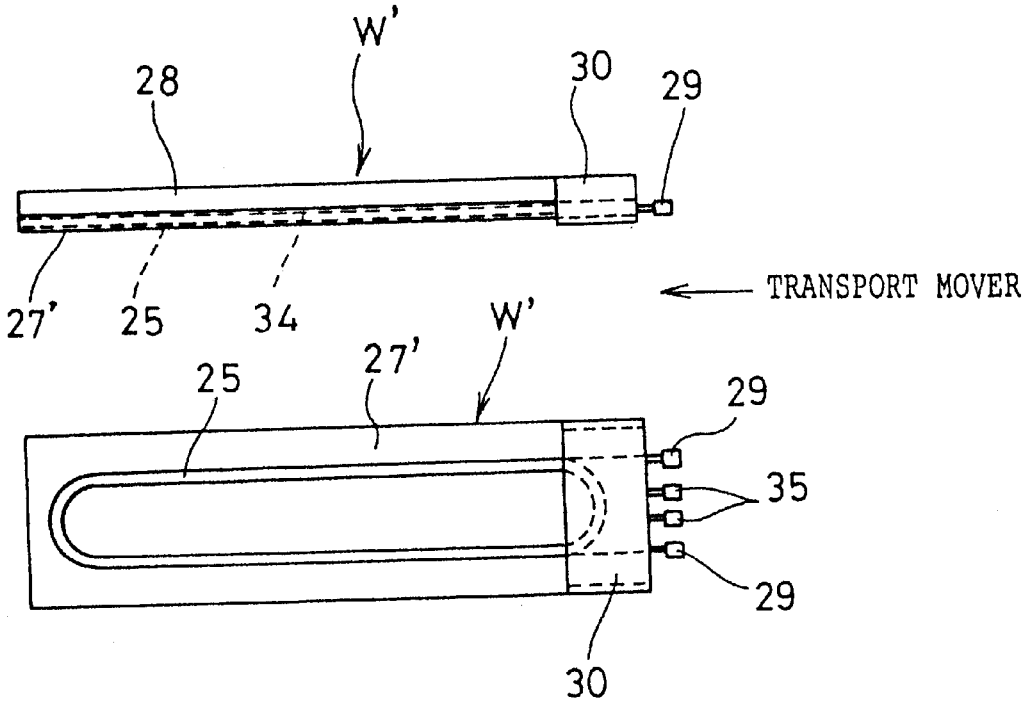
FIG. 7*a* is a side view and FIG. 7*b* is a bottom view of a stopping device of the transport mover travel control system in FIG. 6.

This speed reducing/stopping device W', as shown in FIG. 7, comprises a printed wiring board 27', both surfaces of which are molded with a coil 25 and a second coil 34 with a plurality of turns, a ferrite plate 28 affixed with this printed wiring board 27' to the underside thereof, extractable terminals 29 connected to both ends of the abovementioned coil 25, extractable terminals 35 connected to both ends of the abovementioned second coil 34, and a high-frequency magnetic field cut-off material 30 mounted to the ends of the abovementioned printed wiring board 27' and ferrite plate 28 in the direction the transport mover V enters.

Figure 8:
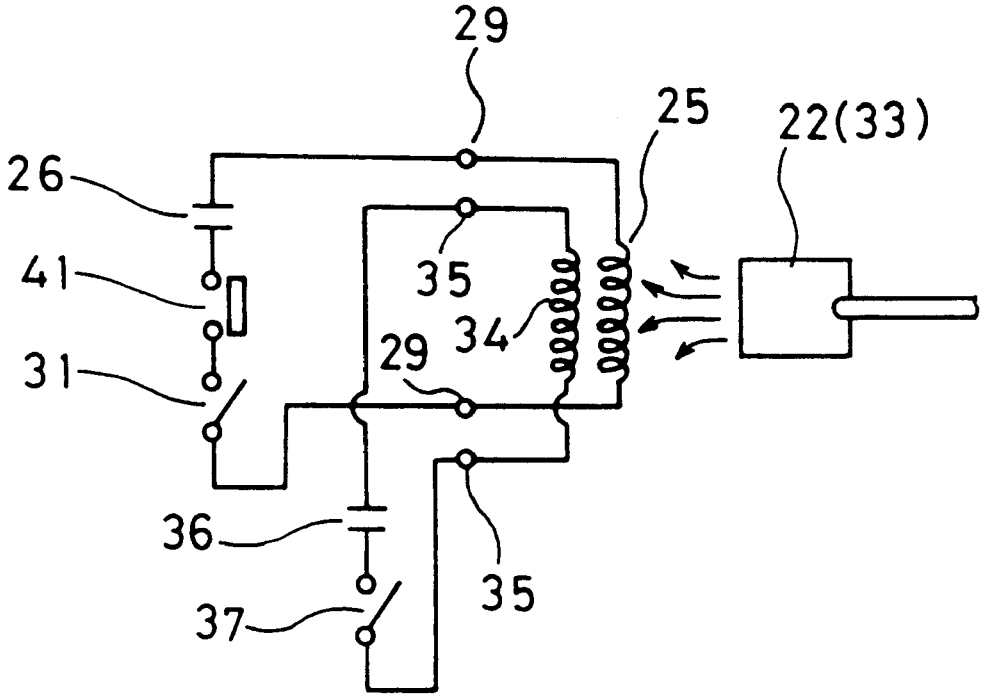
FIG. 8 is a circuit diagram of the stopping device of the transport mover travel control system in FIG. 6.

And as shown in FIG. 8, a condenser 26, the abovementioned limit switch 41 and stop switch 31 are connected to the coil 25 in series via extractable terminals 29. When the abovementioned stop switch 31 is ON and the limit switch 41 is in the ON state, the coil 25 and condenser 26 form a resonant circuit which resonates at the generation frequency (described above as 300 kHz) of the proximity sensor 22. The abovementioned limit switch 41 is normally in the OFF state, and when operated by the driver 42, enters the ON state. Thus, when the stop switch 31 is ON and the limit switch 41 is operated, a resonant circuit is formed, and when the stop switch 31 is OFF, this circuit enters a non-resonating state.

Further, a second condenser 36 and a speed reducing switch 37 are connected to the second coil 34 in series via extractable terminals 35. When the speed reducing switch 37 is in the ON state, the second coil 34 and the second condenser 36 form a second resonant circuit which resonates at the generation frequency (described above as 500 kHz) of the second proximity sensor 33. The second resonant circuit enters a non-resonating state when the speed reducing switch 37 is OFF. Also the second condenser 36, together with the second coil 34, can be molded to the printed wiring board 27'.

The operational process will be explained in accordance with the above-described configuration.

Power is supplied to a transport mover V, via current collectors 12, from current-carrying rails L of the current-carrying rail unit U of the guide rail B. When both proximity sensors 22, 33 are OFF, power is supplied to the reduction gear-equipped electric motor 4. The traveling wheel 2 is driven by the powered reduction gear-equipped electric motor 4, and the transport mover V is guided to move by the guide rail B.

Then, in accordance with its own movement, the transport mover V approaches a preceding transport mover V, and when the second proximity sensor 33 or proximity sensor 22 detects the rear-end collision prevention detection plate 23 of the preceding transport mover V, the sensor turns ON. When the second proximity sensor 33 or proximity sensor 22 turns ON, the supply of power to the reduction gear-equipped electric motor 4 is cut off, the driving of the traveling wheel 2 by the reduction gear-equipped electric motor 4 stops, and the transport mover V comes to a halt. Thus, the transport mover V avoids a rear-end collision with the preceding transport mover V.

Further, when the transport mover V passes a speed reducing/stopping location and the speed reducing switch 37 on the speed reducing/stopping device W' is in the ON state, a second resonant circuit is formed, and the second proximity sensor 33 detects this second resonant circuit and turns ON. When the second proximity sensor 33 is ON, the voltage (or frequency) for supplying power to the reduction gear-equipped electric motor 4 is set low, thus reducing the number of revolutions of the reduction gear-equipped electric motor 4, reducing the rotational speed of the traveling wheel 2, and reducing the speed of the transport mover V. In this state, when the speed reducing switch 37 is OFF, the second resonant circuit enters a non-resonating state, so that the second proximity sensor 33 turns OFF. When the second proximity sensor 33 turns OFF, the voltage for supplying power to the reduction gear-equipped electric motor 4 returns to its original voltage, and the speed of the transport mover V returns to its original speed.

Further, when the transport mover V passes a speed reducing/stopping location, the stop switch 31 on the speed reducing/stopping device W' turns ON, and when the limit switch 41 is operated by the driver 42, a resonant circuit is formed, and the proximity sensor 22 detects this resonant circuit and turns ON. When the proximity sensor 22 turns ON, the supply of power to the reduction gear-equipped electric motor 4 is cut off, the driving of the traveling wheel 2 by the reduction gear-equipped electric motor 4 stops, and the transport mover V comes to a halt. Thus, the transport mover V stops at a predetermined stopping location (location where the limit switch 41 is provided). In this state, when the stop switch 31 on the speed reducing/stopping device W' turns OFF, the resonant circuit enters a non-resonating state and the proximity sensor 22 turns OFF. When the proximity sensor 22 turns OFF, power is re-supplied to the reduction gear-equipped electric motor 4, and the transport mover V starts. Furthermore, when the stop switch 31 is in the OFF state prior to the approach of the transport mover V to a stopping location, the speed reducing/stopping device W' is not detected by the proximity sensor 22, and the transport mover V passes the stopping location without stopping.

In this way, both proximity sensors 22, 33 can also be used as a rear-end collision prevention sensor (strain sensor). The number of sensors can thus be decreased, the amount of wiring on the transport mover V can be decreased, and costs can be reduced. In addition, a space can be left between the speed reducing/stopping device W' and the rear-end collision prevention detection plate 23, and between rear-end collision prevention detection plate 23 and the proximity sensors 22, 33, thereby making it possible to prevent malfunctions and improper operation resulting from the vibration of the transport mover V. Further, it is possible to manufacture a speed reducing detection means (second coil 34) and stopping detection means (coil 25) simultaneously, as well as to reduce mounting space and mounting work, thereby allowing further cost reduction. Also, by moving the location of the limit switch 41 as indicated by the virtual line in FIG. 6, it is possible to adjust the timing of the resonating state, i.e. the stopping position of the mover V.

Furthermore, in the second embodiment described above, two proximity sensors 22, 33 with different frequencies are provided. But, by further providing a plurality of sensors which generate alternating current magnetic fields at different frequencies, providing along the guide rail B resonant circuits which resonate at the generation frequencies of each of these proximity sensors, and further providing a switching means which switches the resonating state to and from the non-resonating state in each resonant circuit, it is possible to transmit various signals to a mover V.

For example, various information is assigned to each resonant circuit, such as whether or not cargo is to be transferred at the next stopping location, i.e. a station, or whether the transport mover is to move to a storage line, and while each resonant circuit is kept in the resonating state, corresponding proximity sensors are operated, so that various information can be transmitted to a mover V.

Furthermore, in the above-described first and second embodiments, power supply to a transport mover V is carried out using a feed rail L and a current collector 12, but the present invention can also be applied to a transport mover which is supplied power on a non-contact basis.

Figure 9:
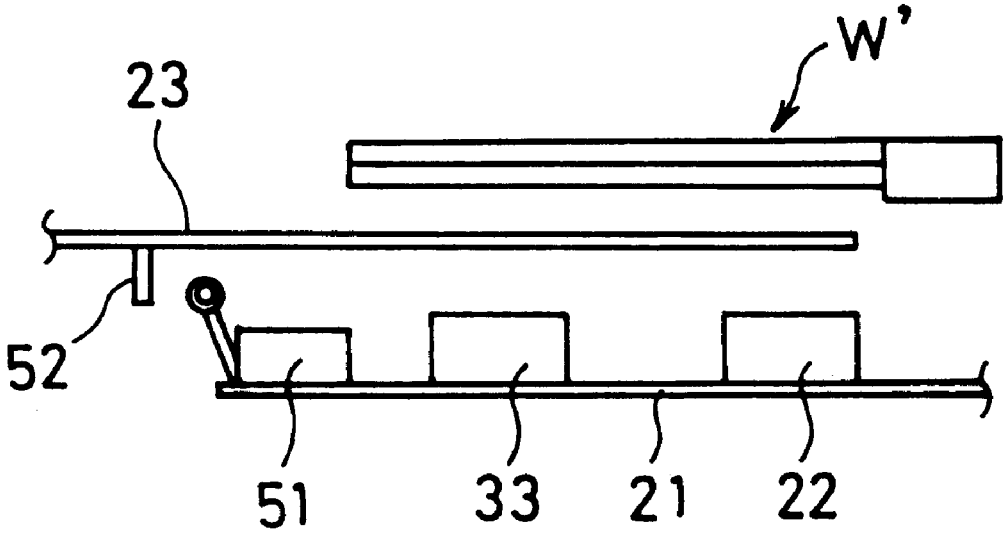
FIG. 9 is a diagram depicting the locations of a stopping device, a detection plate and a proximity sensor of a transport mover travel control system of another embodiment of the present invention.

Further, in the above-described first and second embodiments, a transport mover V is stopped by the detection output of the proximity sensor 22, 33. But, as shown in FIG. 9, it is also possible to position a limit switch 51 at a location forward of the second proximity sensor 33, to provide a detection object 52 which operates this limit switch 51 on the rear-end collision prevention detection plate 23, and to shut off the power to the motor 4 and stop the transport mover V by operating this limit switch 51. This limit switch 51 enables the transport mover V to avoid a rear-end collision with the preceding transport mover V even when the proximity sensor 22, 33 fails to operate. The mounting location of the abovementioned detection object 52 to the rear-end collision prevention detection plate 23 is such that the detection object 52 makes contact with the limit switch 51 after the rear-end collision prevention detection plate 23 reaches the location of the proximity sensor 22.

What is claimed is:

1. A travel control system comprising:

a plurality of transport movers that move under their own power along a rail;

a proximity sensor provided at the front end of each of said transport movers, and generating an alternating current magnetic field in the direction of the rail and detecting a to-be-detected object according to a loss of energy from the magnetic field, said loss of energy resulting from feeding a current to the to-be-detected object from the magnetic field;

a resonant circuit provided at a mover stopping location on the rail, said resonant circuit facing toward the proximity sensor and resonating at a generation frequency of the proximity sensor;

switching means provided in said resonant circuit and switching the resonant circuit into a resonating state to stop the transport mover and into a non-resonating state to permit the transport mover to pass; and a detection object for preventing collision of the transport movers, provided at the rear end of each of said transport movers to be able to enter between the rail and the proximity sensor, said detection object being detectable by the proximity sensor, wherein said proximity sensor detects the detection object and the resonant circuit.

2. A travel control system comprising:

a plurality of transport movers that move under their own power along a rail;

a first proximity sensor and a second proximity sensor provided at the front end of each of said transport movers, and generating an alternating current magnetic filed having a different frequency from each other in the direction of the rail and detecting a to-be-detected object according to a loss of energy from the magnetic filed, said loss of energy resulting from feeding a current to the to-be-detected object from the magnetic field;

a first resonant circuit facing toward the first proximity sensor and resonating at a generation frequency of the first proximity sensor and a second resonant circuit facing toward the second proximity sensor and resonating at a generation frequency of the second proximity sensor, said first and second resonant circuits being provided on the rail at a location where the transport mover decelerates and stops;

a first switching means provided in the first resonant circuit and switching the resonant circuit into a resonating state to stop the transport mover and into a non-resonating state to permit the transport mover to pass;

a second switching means provided in the second resonant circuit and switching the resonant circuit into a resonating state to decelerate the transport mover and into a non-resonating state to permit the transport mover to pass; and a detection object for prevent collision of the transport movers, provided at the rear end of each of said transport movers, said detection object being detectable by the first proximity sensor and the second proximity sensor, wherein said first proximity sensor detects the detection object and the first resonant circuit, and said second proximity sensor detects the detection object and the second resonant circuit.

3. The travel control system according to claim 2, wherein the first and second resonant circuits, the detection object for preventing collision of the transport movers, and the first and second proximity sensors are arranged in order in a downward vertical relation.

* * * * *